US009603475B2

(12) United States Patent
Faulk

(10) Patent No.: US 9,603,475 B2
(45) Date of Patent: Mar. 28, 2017

(54) FOOD TRAY CUP HOLDER

(71) Applicant: Maurice J. Faulk, Pittsburgh, PA (US)

(72) Inventor: Maurice J. Faulk, Pittsburgh, PA (US)

( * ) Notice: Subject to any disclaimer, the term of this patent is extended or adjusted under 35 U.S.C. 154(b) by 0 days.

(21) Appl. No.: 14/634,531

(22) Filed: Feb. 27, 2015

(65) Prior Publication Data

US 2015/0238034 A1 Aug. 27, 2015

Related U.S. Application Data

(60) Provisional application No. 61/945,598, filed on Feb. 27, 2014.

(51) Int. Cl.
*A47G 23/06* (2006.01)

(52) U.S. Cl.
CPC ..... *A47G 23/0641* (2013.01); *A47G 23/0633* (2013.01)

(58) Field of Classification Search
CPC ..... A47G 23/0633; A47G 23/0641; A47G 2400/10; A47G 23/06
USPC ..... 220/23.86, 23.83
See application file for complete search history.

(56) References Cited

U.S. PATENT DOCUMENTS 1,926,481 A * 9/1933 Fox ..... 206/562
4,284,204 A * 8/1981 Carey, Jr. ..... B65D 11/12 206/1.5
4,947,991 A * 8/1990 Snell ..... 206/427
5,123,527 A * 6/1992 Hustad ..... B65D 1/36 206/549

* cited by examiner

*Primary Examiner* — Stephen Castellano
(74) *Attorney, Agent, or Firm* — Gary P. Topolosky

(57) ABSTRACT

A cup holder for holding a plurality of cups on a food tray comprises a pair of spaced apart lower lip extensions for fitting onto the food tray; a sidewall region extending upwardly from each lower lip extension; and a top plane region that connects both sidewall regions and extends: substantially perpendicular to the sidewall regions and substantially parallel to a flat upper surface of the food tray. This top plane region includes a plurality of spaced apart apertures that hold a beverage cup while transporting food and drinks on the food tray.

18 Claims, 3 Drawing Sheets

FOOD TRAY CUP HOLDER

CROSS-REFERENCE TO RELATED APPLICATION

This is a perfection of U.S. provisional application Ser. No. 61/945,598, filed on Feb. 27, 2014, the disclosure of which is fully incorporated by reference herein.

FIELD OF THE INVENTION

This invention relates to cup holders for plates and food trays. It is especially concerned with devices adapted for use with typical food court trays that are generally rectangular and may come in several common sizes. Most importantly, the present invention allows existing food trays to be quickly fitted for carrying several (two or three) beverage cups on a tray with room to spare for still transporting food items thereon.

BACKGROUND OF THE INVENTION

Numerous food and beverage trays are known and have been patent protected. In chronological order, these include:

Eraut U.S. Pat. No. 2,772,934 showed a food service tray (with a clip-on holder for two beverages, said tray designed for affixing to the front seat of an automobile.

Cramer U.S. Pat. No. 2,808,191 showed a lap tray with specially sized recesses to hold a food plate and cup.

Dunn U.S. Pat. No. 2,875,940 showed a portable food container for a car seat in which a pair of beverage holders surrounds a recessed pocket for holding food.

Farrell U.S. Pat. No. 3,115,251 disclosed an individualized plate and cup holder having a plurality of adjustable plate clips.

Thomas U.S. Pat. No. 3,498,470 showed a food serving tray with a built in, partially raised integral holder for one cup.

Florian U.S. Pat. No. 3,942,671 disclosed a food carryout tray designed to hold/carry differing sizes of beverage cups.

Vigue U.S. Design Pat. No. D250,243 showed a feed/beverage tray combination able to integrally hold a beverage cup at each of the four tray corners.

Distler U.S. Pat. No. 6,036,020 showed a dinner tray with at least two octagonal cup holders integrally formed along one side of the tray proper.

Williams U.S. Pat. No. 6,129,232 showed a lidded food and beverage tray that, when flipped onto itself, forms a retention well for holding beverages.

Rathjen U.S. Pat. No. 6,149,027 has a food plate and beverage holder combination with a truncated cone intended for holding stemmed glassware.

Loh U.S. Pat. No. 6,988,636 showed a thermoplastic food and beverage tray/carrier that incorporates a drawer between the tray and frame sections.

Hurtado et al. U.S. Pat. No. 7,484,653 showed a food carrying tray with lockable tabs for forming two cup holders at opposite corners.

Cannon et al. U.S. Pat. No. 8,176,855 has a food tray with foldable legs, said tray including one or more drink "bands" for affixing to adjacent sides at a corner intersection of the tray.

Thornton Published U.S. Application No. 2013/0015097 showed a molded rubber or polymer extruded supplemental tray for fitting onto the typically sized, food carrying tray of a restaurant. The supplemental tray includes recesses for holding a plurality of beer cans and bottles.

Finally, Ferreira PCT Application No. WO2013/115,662 showed a disposable cup fastener that temporarily affixes to a corner of a food carrying tray.

SUMMARY OF THE INVENTION

This invention represents an improved way for making it safer to transport a plurality of drinks on the same (unmodified) food tray as is typically found in a fast food restaurant and/or food court. With these specially sized, raised cup holders, it is possible to rapidly affix a holder to the short or long sides of a food tray and safety (hands-free) carry a fully loaded tray to a table for handing out to anxious (hungry) family members.

One embodiment includes a cup holder for either the short or long sides of a tray with two or possibly three apertures for holding restaurant-issued beverage containers (cups). A first alternative provides each aperture with known or subsequently developed tabs, spacers or the like for more firmly holding in place (for transport to a table) a plurality of cups that may be sized differently. Yet another alternative provides a tray cup holder that can be physically adjusted (i.e., spread longer/wider) to fit differently sized food trays or for using the same cup holder model to hold a plurality of cup/containers along either the short or long side of a food tray.

BRIEF DESCRIPTION OF THE DRAWINGS

Further features, objectives and advantages will become clearer from the following Detailed Description made with reference to the accompanying drawings in which.

DESCRIPTION OF PREFERRED EMBODIMENTS

It is an object of this invention to provide a holder for two or more cups on a pre-existing food tray such as those used in many fast food restaurants and/or mall food courts.

Another object of the invention is to provide a food tray cup holder that is lightweight, easily shipped and stored when not in use and convenient to install and use.

A further object of the invention is to provide a cup holder which is inexpensive to produce and yet relatively durable.

Yet another object is to provide a cup holder, which, depending on the material and method of manufacture, may be made for repeated use, or used only once and disposed of (possibly even made from recyclable materials such as cardboard, metal, plastics, or combinations thereof).

Other objects and advantages of the present invention will be apparent from the accompanying drawings.

Figure 1:
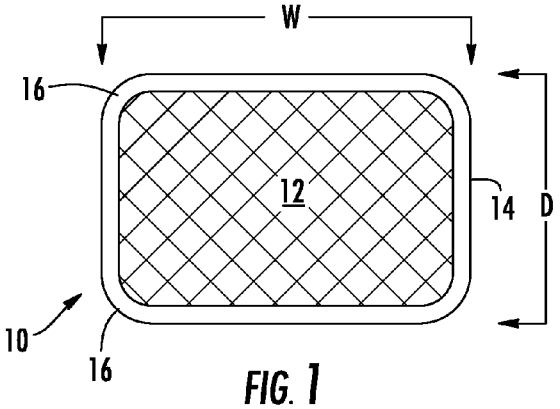
FIG. 1 is a top plan view of a typical food court tray with markers indicating its depth D (or short) side and width W (or long) side.
Figure 2:
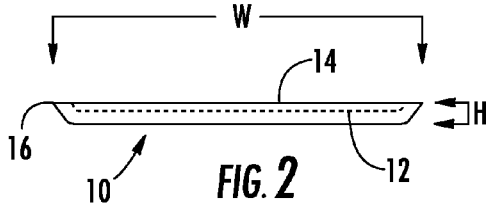
FIG. 2 is a front plan view of the typical tray from FIG. 1.
Figure 3:
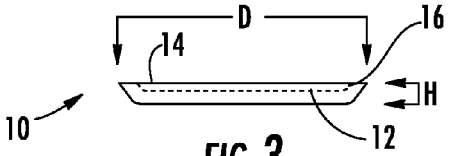
FIG. 3 is a side view of the FIGS. 1 and 2 tray.
Figure 4A:
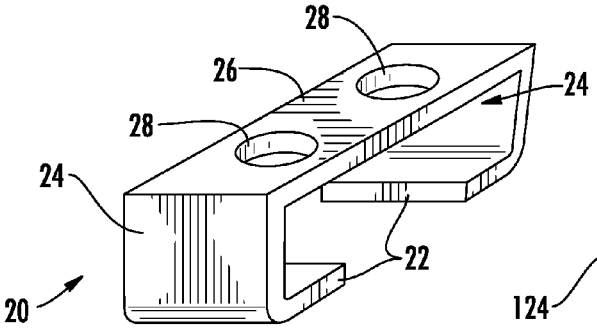
FIG. 4A is a perspective view of one embodiment of two-cup holder according to this invention.
Figure 4B:
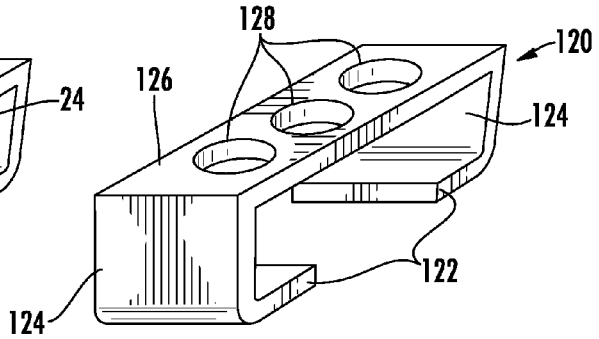
FIG. 4B is a perspective view of one embodiment of three-cup holder according to this invention.
Figure 5A:
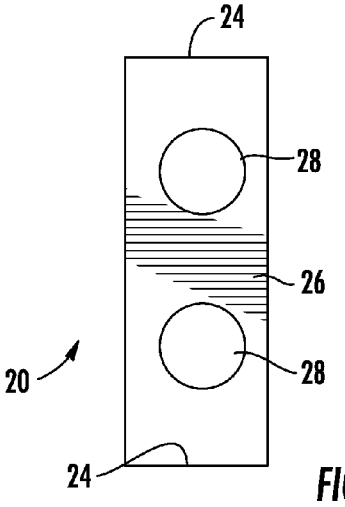
FIG. 5A is a top plan view of the holder from FIG. 4A.
Figure 5B:
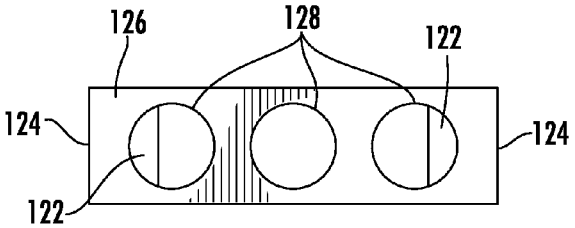
FIG. 5B is a top plan view of the holder from FIG. 4B.

In the accompanying FIGURES, component elements common to the various embodiments are commonly numbered, though in the next hundred series. Furthermore, FIGS. 1 through 3 show in various dimensional views, a typical food serving food tray 10 with a flat base area 12, curved or rounded lip edge 14 and usually rounded corners 16. Such trays are most often dimensioned to be wider W than they are deep D. The height H of such trays may vary but they rarely exceed one inch. A plurality of such trays are stacked and stored for repeated use.

For FIGS. 4A, 5A, 7A, 8A and 10A, a first embodiment of cup holder according to this invention attaches depthwise, or to the short side S of a typical rectangular shaped food tray 10. The cup holder itself, generally 20, comprises a pair of spaced apart lower lip extensions 22 for fitting to the underside of a standard food tray 10. These lip extensions 22 each curve to a sidewall region 24 sized to fit comfortably, though not necessarily "snugly", against the food tray's overall height dimension H. The two sidewalls 24 then angle inwardly and substantially perpendicularly to form a top plane region 26 that should preferably extend substantially parallel to flat base area 12 of the food tray 10 over which cup holder 20 is installed. This embodiment of the shorter side cup holder 20 is shown with a pair of pre-cut, spaced apart cup holes, or apertures 28 through which a beverage cup is placed for holding while the user transports a tray full of food and drinks to an eating destination (open table and chairs) in a food court or otherwise.

Figure 6:
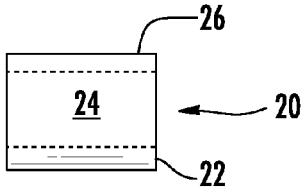
FIG. 6 is a front plan view of the FIGS. 4A and B holders.
Figure 7A:
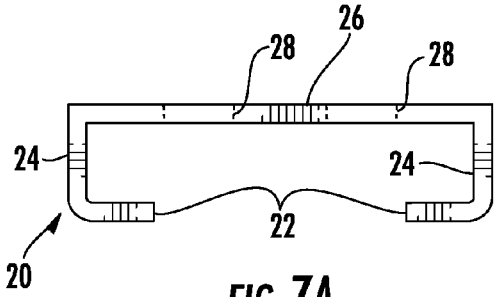
FIG. 7A is a side view of the two-cup model holder from FIG. 4A.
Figure 7B:
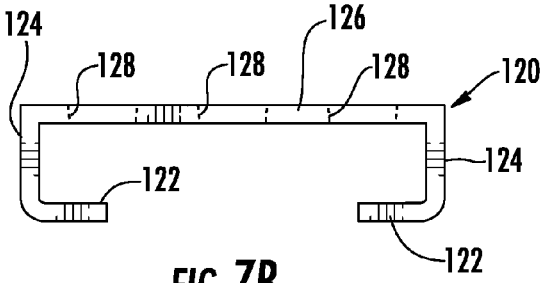
FIG. 7B is a side view of the three-cup model holder from FIG. 4B.
Figure 8A:
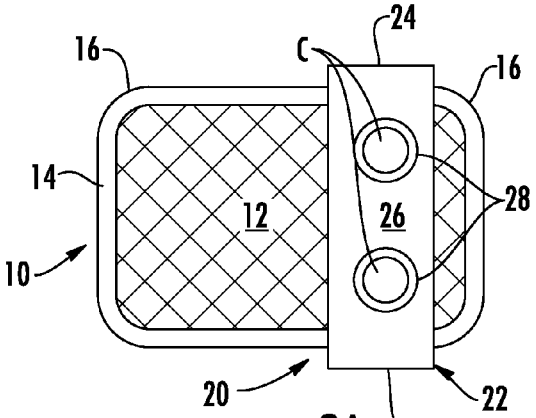
FIG. 8A is a top plan view of the FIG. 5A holder, with two cups, affixed to a tray.
Figure 8B:
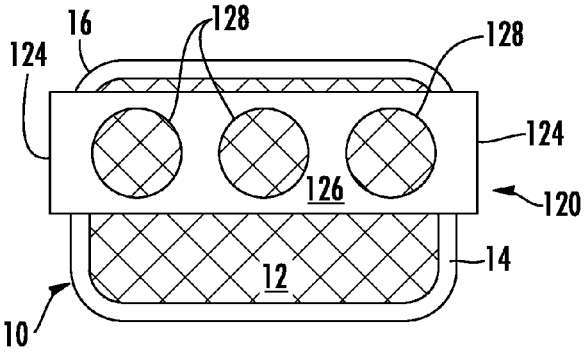
FIG. 8B is a top plan view of the FIG. 5B holder, with three cups, affixed to a tray.
Figure 9:
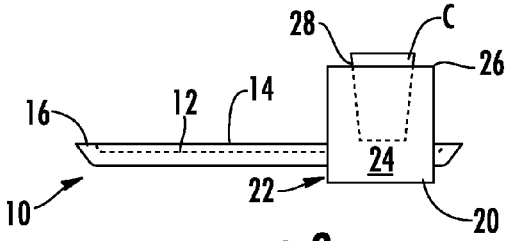
FIG. 9 is a front plan view of the holder, with cups, on a tray.
Figure 10A:
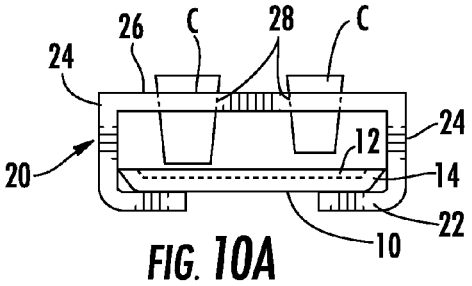
FIG. 10A is a side view of the holder and 2 cups depthwise on a typical tray.
Figure 10B:
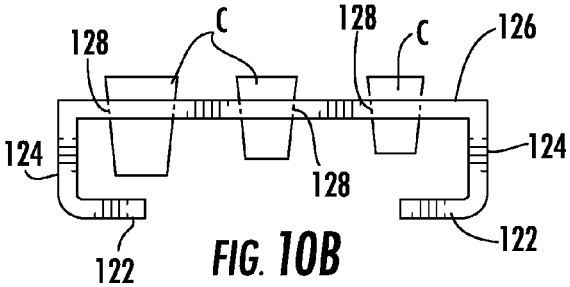
FIG. 10B is a side view of the holder and 3 cups widthwise on the same tray.

In FIGS. 8A, 9 and 10A, same cup holder 20 is shown, in use (or in operation) holding two cups C, one in each of the two apertures 28. FIGS. 6 and 9 focus on the side views of this representative, two-cup holder 20, first empty (FIG. 6), then "in use" at FIG. 9.

In a first alternate embodiment, FIGS. 4B, 5B, 7B, 8B and 10B show a three-cup variation of holder 120 with its corresponding lip extensions 122, sidewall regions 124, top plane region 126 and apertures 128 (now three in number for this longer variation for going across the broader width W of a typical food tray 10. Once more, this holder 120 is meant to easily fit widthwise, across the far end, or the longer "side" of a typical tray with the carrier's hands positioned on either end of the shorter depth sides D.

Unfortunately, even the carrying of a single cup with one's food items can become a precarious exercise. No matter what upper surface is employed on these trays, the general imbalance of a filled beverage cup (let alone multiple cups for the same food order) tends to lead one in an awkward balancing act from the counter where the food is served to the table where it will be eaten. Too often, these treks across crowded restaurants and/or food courts end in drink spills on or about the tray or worse. There have also been total losses of one or more drinks from the tray and onto the table, restaurant floor or, worst of all, on an unsuspecting family member or fellow customer in the purchaser's path to an open table and chair set.

The independent, stand-alone cup holders of this invention do NOT require full integration into any one tray (food holder) design. Rather, these cup holders can be easily clipped over and onto a tray by the server before the rest of the food order is situated thereon. Alternately, a semi-filled food tray can be raised, kept somewhat level (i.e. parallel to the serving counter) and then slid sideways into these cup holder shapes, sizes and designs. Depending on the "give" of the material of construction, it may be more preferred to provide greater structural rigidity than to provide ease of optional installation around and about a plurality of food trays, all being commonly sized in depth.

Should the same restaurant/food court have trays that vary (even ever so slightly) in depth, alternate versions of this invention may include adjustment means/clips/spreaders for fitting over a first tray about 10 inches deep, and then expand to fit over a second tray, up to 12 inches deep.

Conversely, if more than two drinks are commonly served in a "family" order, the cup holders herein may be made to fit widthwise, across the outer rear region of a food tray (3 or 4 cups across) with the remainder of the food order situated in front of the beverages and closer to the body/chest area of the tray carrier.

Another optional variation of this invention can include individualized cup adapters so that the diameter of an adult serving cup can be carried with the same tray holder as a child's size. See, for example, how the different cup depths of a "loaded" holder can be seen in FIG. 10: the left cup reaches down to the tray while the smaller serving size suspends partially above the flat upper surface 12 of serving tray 10.

Figure 11:
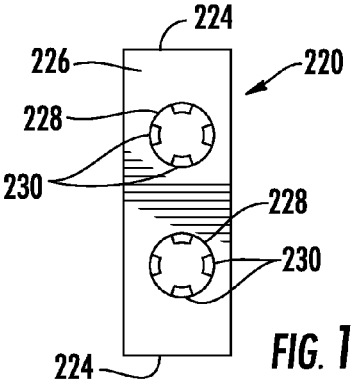
FIG. 11 is a top plan view showing a first alternative embodiment with one version of adjustable tabs for different sized cups.

That "option" is exaggerated further in the second alternative embodiment of FIG. 11 wherein cup holder 220 includes with its top planar region 226, apertures 228 with integral cup holding tabs 230 for holding a full beverage cup more securely white commuting to one's final eating destination.

Figure 12:
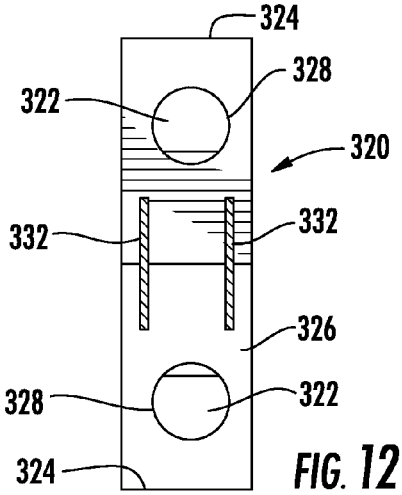
FIG. 12 is a top plan view of a second alternative embodiment showing a variation with adjustable depth (or width)
Figure 13:
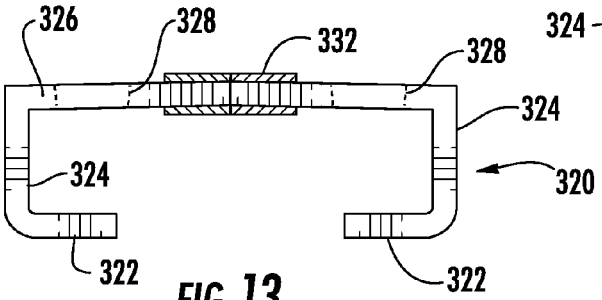
FIG. 13 is a side view of the second alternative embodiment from FIG. 12.

In some operations, it may be desirable to have a cup holder, like component 320 in FIGS. 12 and 13, that includes extension means 332 for giving ONE model of cup holder an ability to be stretched apart by spring action or by the implementation of a pair of spacer bars for spreading farther apart: either to accommodate the differing depths D of food trays in the same food court (from different food suppliers) or for allowing the same one model to be used multi-directionally, i.e., either depthwise or, when spread apart forth widthwise.

Figure 14:
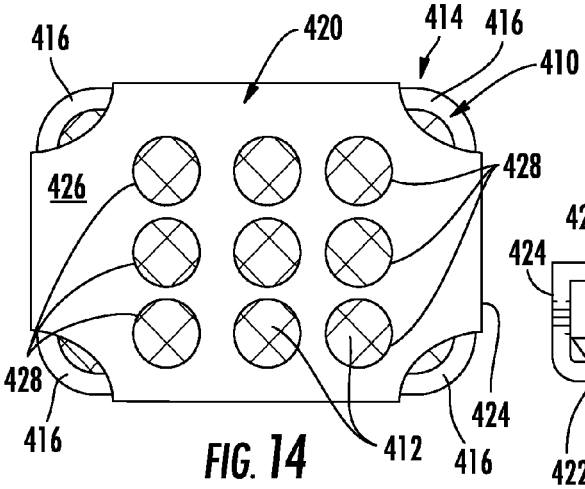
FIG. 14 is a top plan view of a third embodiment for a plurality of cups (as shown, nine cups)
Figure 15:
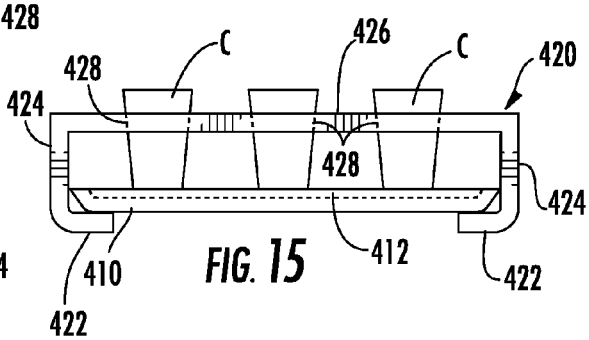
FIG. 15 is a side view of the third alternative from FIG. 14 with several cups held thereby.

Yet another variation is depicted in accompanying FIGS. 14 and 15. Therein, a standard sized, rectangular food tray 410 is fitted with just a cup holder ONLY option. In this case, the tray up adapter 420 contains in its top planar region 426 apertures 428 for comfortably holding up to nine representative cups (three cups C are shown, in place, in FIG. 15). It is to be understood, however, that more or fewer variations may be included in a single cup holder tray adapter depending on the overall size/weight strength of said standardized food tray.

Preferably, the cup holders of this invention can be made, as an integral one-piece unit, from molded plastics, rubberized materials (like most food serving trays, for instance). Or, they may be formed from sheet metal, like aluminum or stainless steel. If reuse is less of an issue, every reinforced cardboard alternatives may be considered.

As will be apparent from the foregoing description, cup holders constructed in accordance with the present invention wilt be convenient to use and solve many problems associated with the transport of food items from service counter to table. Such holders will be light in weight and easily stored, particularly permitting the nesting (or stacking) of several holders together.

While a number of modifications of the preferred form have been described above, it will be understood that many other variations and modifications can be made without departing from the spirit of the invention.

What is claimed is:

1. In combination, a food tray having a flat upper surface and a bottommost surface and a cup holder for holding a plurality of beverage cups on a portion of the food bay with at least a portion of the food tray available for holding one or more food products thereon, said cup holder comprising:

a pair of spaced apart lower lip extensions fitting about opposed side edges of the food tray and contacting the bottommost surface of the food tray while leaving at least two adjacent corners of the food tray uncovered by the cup holder;

a sidewall region extending upwardly from each lower lip extension; and a top plane region extending substantially perpendicular to and connecting both sidewall regions, said top plane region: (i) extending substantially parallel to the flat upper surface of the food tray when installed thereon and (ii) having a plurality of spaced apart apertures, each aperture intended to hold a beverage cup while the food tray is used to transport food and drinks to an eating destination.

2. The combination food tray and cup holder of claim 1, which is sized to fit on a long side of the food tray, extend parallel to a short side of the food tray and carry at least two beverage cups.

3. The combination food tray and cup holder of claim 1, which is sized to fit on a short side of the food tray, extend parallel to a long side of the food tray and carry at least three beverage cups.

4. The combination food tray and cup holder of claim 1, which includes width adjustment means for fitting onto either a short side or a long side of the food tray.

5. The combination food tray and cup holder of claim 4 wherein the width adjustment means includes a spring insert for the top plane region of the cup holder.

6. The combination food tray and cup holder of claim 4 wherein the width adjustment means includes a slidable extension section for the top plane region of the cup holder.

7. The combination food tray and cup holder of claim 1 wherein the apertures include a plurality of adjustable tabs for holding different sized beverage cups.

8. The combination food tray and cup holder of claim 1, which is made from molded plastic or a rubberized material.

9. The combination food tray and cup holder of claim 1, which is made from metal or a metal composite.

10. The combination food tray and cup holder of claim 1, which is made from reinforced cardboard.

11. The combination food tray and cup holder of claim 1, which is sized to clip onto both a short side and a long side of the food tray for holding rows of beverage cups, each row containing two or more beverage cups.

12. The combination food tray and cup holder of claim 11, which is capable of carrying at least 9 beverage cups for transport.

13. The combination food tray and cup holder of claim 1 wherein the cup holder leaves a majority of the food tray available for holding one or more food products thereon.

14. A combination of a food tray having a flat upper surface and a bottommost wall and a flexible one-piece cup holder for holding two or three beverage cups onto a portion of the food tray with at least a portion of the food tray available for holding one or more food products thereon, said cup holder being made from molded plastic or a rubberized material and comprising:

a pair of spaced apart lower lip extensions fitting about opposed side edges and contacting with the bottommost wall of the food tray while leaving at least two adjacent corners of the food tray uncovered by the cup holder;

a sidewall region extending upwardly from each lower lip extension; and a top plane region extending: substantially perpendicular to and connecting both sidewall regions and substantially parallel to the flat upper surface of the food tray when installed thereon, said top plane region having two or more, spaced apart apertures, each aperture intended to hold a beverage cup when the food tray is used for carrying food and drinks to a table.

15. The combination food tray and cup holder of claim 14, which is sized to fit on a long side of the food tray, extend parallel to a short side of the food tray and carry at least two beverage cups.

16. The combination food tray and cup holder of claim 14, which is sized to fit on a short side of the food tray, extend parallel to a long side of the food tray and carry three beverage cups.

17. The combination food tray and cup holder of claim 14 wherein the apertures include a plurality of adjustable tabs for holding different sized beverage cups.

18. The combination food tray and cup holder of claim 14 wherein the cup holder leaves a majority of the food tray available for holding one or more food products thereon.

* * * * *